US011207893B2

(12) United States Patent
Nishiyama et al.

(10) Patent No.: US 11,207,893 B2
(45) Date of Patent: Dec. 28, 2021

(54) INK SERVER AND INK SUPPLY SYSTEM

(71) Applicant: SEIKO EPSON CORPORATION, Tokyo (JP)

(72) Inventors: Toshiyuki Nishiyama, Nagano (JP); Shohei Yamada, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 16/795,664

(22) Filed: Feb. 20, 2020

(65) Prior Publication Data

US 2020/0269593 A1 Aug. 27, 2020

(30) Foreign Application Priority Data

Feb. 22, 2019 (JP) ..... JP2019-030271

(51) Int. Cl.
*B41J 2/175* (2006.01)

(52) U.S. Cl.
CPC ..... *B41J 2/17566* (2013.01)

(58) Field of Classification Search
CPC ..... B41J 2/01; B41J 2/175; B41J 2/17566; B65D 88/00
See application file for complete search history.

(56) References Cited

U.S. PATENT DOCUMENTS

| | | | | |
|---|---|---|---|---|
| 4,010,683 | A * | 3/1977 | Lambert | B41F 31/08 101/366 |
| 4,495,568 | A * | 1/1985 | Gilbert | G06F 11/328 713/330 |
| 8,668,293 | B2 | 3/2014 | Harada | |
| 2015/0022572 | A1 | 1/2015 | Nishiyama et al. | |
| 2018/0086092 | A1 | 3/2018 | Koganehira et al. | |
| 2018/0088876 | A1* | 3/2018 | Takata | G06F 3/1236 |

FOREIGN PATENT DOCUMENTS

| | | | | |
|---|---|---|---|---|
| CN | 205274251 | * | 6/2016 | B65D 88/00 |
| JP | 2004-314392 | A | 11/2004 | |
| JP | 2008-100435 | A | 5/2008 | |

* cited by examiner

*Primary Examiner* — Anh T Vo
(74) *Attorney, Agent, or Firm* — Global IP Counselors, LLP

(57) ABSTRACT

The ink server includes at least one ink storage unit that stores ink to be supplied to a printer, a switching unit that switches whether to supply the ink stored in the at least one ink storage unit to the printer, a detection unit that detects a state of the ink stored in the at least one ink storage unit, a controller that controls the switching unit and the detection unit, and a power supply circuit that supplies a power supply voltage to the switching unit, the detection unit, and the controller.

18 Claims, 7 Drawing Sheets

INK SERVER AND INK SUPPLY SYSTEM

The present application is based on, and claims priority from JP Application Serial Number 2019-030271, filed Feb. 22, 2019, the disclosure of which is hereby incorporated by reference herein in its entirety.

BACKGROUND

1. Technical Field

The present disclosure relates to an ink server and an ink supply system.

2. Related Art

JP-A-2004-314392 and JP-A-2008-100435 disclose an ink supply system including a plurality of printers and an ink server that supplies ink to the plurality of printers.

An ink server in the related art detects, for example, the remaining amount of ink stored in an ink cartridge and the like in accordance with an instruction from a printer. For this reason, in the ink server in the related art, there is a possibility that the process of detecting the remaining amount of ink may not be performed due to the state of the printer that gives an instruction to the ink server. For example, when the power of the printer that gives an instruction to the ink server is turned off, the process of detecting the remaining amount of ink is not performed on the ink server in the related art. When the process of detecting the remaining amount of ink is not performed, the ink stored in the ink cartridge may be depleted during the printing process, and the supply of ink from the ink server to the printer may be interrupted. That is, in the ink server in the related art in which the process of detecting the remaining amount of ink is performed depending on an instruction from the printer, there is a possibility that ink cannot be stably supplied to the printer.

SUMMARY

In order to solve the above-mentioned problems, according to an aspect of the present disclosure, an ink server includes at least one ink storage unit that stores ink to be supplied to a printer, a switching unit that switches whether to supply the ink stored in the at least one ink storage unit to the printer, a detection unit that detects a state of the ink stored in the at least one ink storage unit, a controller that controls the switching unit and the detection unit, and a power supply circuit that supplies a power supply voltage to the switching unit, the detection unit, and the controller.

DESCRIPTION OF EXEMPLARY EMBODIMENTS

An embodiment of the present disclosure will be described with reference to FIGS. 1 to 3. However, in each figure, the size and scale of each part are appropriately changed from the actual ones. In addition, since the embodiments described below are preferable specific examples of the present disclosure, there are various technically preferred limitations. However, the scope of the present disclosure is not limited to these embodiments unless otherwise specified in the following description.

Figure 1:
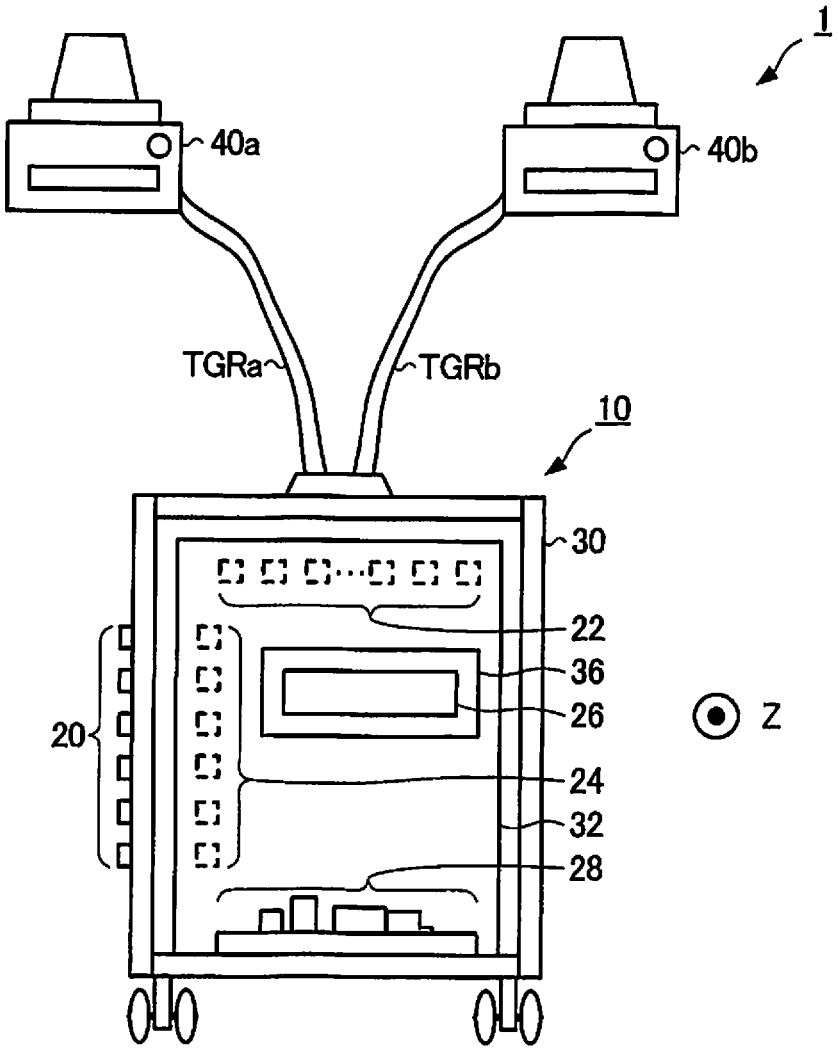
FIG. 1 is an explanatory diagram of an ink supply system according to an embodiment of the present disclosure.

FIG. 1 is an explanatory diagram of an ink supply system 1 according to an embodiment of the present disclosure. The ink supply system 1 includes printers 40*a* and 40*b* and an ink server 10 that supplies ink to the printers 40*a* and 40*b*. Hereinafter, the printers 40*a* and 40*b* may be referred to as a printer 40 without particular distinction. Details of the ink server 10 will be described with reference to FIG. 2. Therefore, an outline of the ink server 10 will be described with reference to FIG. 1.

The ink server 10 supplies each color of ink to the printer 40*a* installed outside a housing 30 described later via an ink supply tube group TGRa. The ink supply tube group TGRa includes, for example, ink supply tubes 38Ba, 38Ya, 38Ma, 38Ca, 38LMa, and 38LCa provided for the six colors of ink shown in FIG. 2. The ink server 10 supplies each color of ink to the printer 40*b* installed outside the housing 30 via an ink supply tube group TGRb. The ink supply tube group TGRb includes, for example, ink supply tubes 38Bb, 38Yb, 38Mb, 38Cb, 38LMb, and 38LCb provided for the six colors of ink shown in FIG. 2. In FIG. 1, signal lines 37*a* and 37*b* shown in FIG. 2 are not shown in order to make the figure easier to see.

The ink server 10 includes, for example, a plurality of ink cartridges 20, a plurality of switching units 22, a plurality of sensors 24, a controller 26, and a power supply circuit 28. The ink cartridge 20 is an example of an ink storage unit, and the sensor 24 is an example of a detection unit. In the example illustrated in FIG. 1, the ink cartridges 20, the switching units 22, the sensors 24, the controller 26, and the power supply circuit 28 are stored in the housing 30. The controller 26 is disposed on a substrate 36. The substrate 36 is installed on a sheet metal 32 that separates the ink cartridges 20 and the power supply circuit 28. In FIG. 1, the direction perpendicular to the surface of the sheet metal 32 on which the substrate 36 is installed is referred to as the Z direction, and the direction toward the position where the power supply circuit 28 is disposed with respect to the sheet metal 32 is referred to as the positive Z direction. Since the switching units 22 and the sensors 24 are located in the negative Z direction with respect to the sheet metal 32, they are indicated by broken lines.

The ink cartridge 20 stores ink supplied to the printer 40. The ink cartridge 20 is provided for each color of ink, and is detachably attached to the ink server 10. The switching unit 22 is provided in a one-to-one correspondence with the printer 40 in each ink cartridge 20, and switches whether to supply the ink stored in the ink cartridge 20 to the printer 40. The switching unit 22 is, for example, an on-off valve that opens/closes the ink flow path, and is electrically coupled to the controller 26. As the on-off valve, for example, an electromagnetic on-off valve that opens/closes according to the action of an electromagnet can be used.

The sensor 24 is provided for each ink cartridge 20 and detects the state of the ink stored in the ink cartridge 20. For example, the state of the ink to be detected refers to some or all of the remaining amount of ink stored in the ink cartridge 20, the viscosity of ink, the use period of ink, and the degree of sedimentation of ink components. The state of the ink to be detected is not limited to the above example.

The controller 26 refers to a computer such as a central processing unit (CPU) that controls the operation of the ink server 10, for example. The controller 26 may have one or a plurality of processors. The controller 26 controls the switching units 22 and sensors 24 by reading and executing a program stored in a storage device (not shown). All or part of the elements implemented by the controller 26 reading and executing the program may be implemented by hardware configured by an electronic circuit such as a field programmable gate array (FPGA) or an application specific IC (ASIC). Alternatively, all or some of the functions of the controller 26 may be implemented by cooperation of software and hardware.

The power supply circuit 28 supplies a power supply voltage to the switching units 22, the sensors 24, and the controller 26. For example, the power supply circuit 28 transforms an AC voltage supplied from a commercial AC power supply, smoothes the AC voltage after the transformation, and converts it into a DC voltage. The power supply circuit 28 supplies a DC voltage as a power supply voltage to the switching units 22, the sensors 24, and the controller 26. A conversion circuit that converts the commercial AC power supply to a DC voltage may be provided outside the power supply circuit 28. In this case, the power supply circuit 28 may supply the DC voltage supplied from the conversion circuit as the power supply voltage to the switching units 22, the sensors 24, and the controller 26.

The printer 40 refers to, for example, an ink jet printer that ejects ink to form an image on recording paper. The printer 40 receives print data indicating an image to be printed by the printer 40 from a host computer (not shown). The printer 40 transmits an ink request signal for requesting supply of ink to the printer 40 to the ink server 10 based on the print data. The printer 40 uses the ink supplied from the ink server 10 to print the image indicated by the print data.

The printer 40 may have any of a copy function, a scanner function, a facsimile transmission function, and a facsimile reception function in addition to the printing function. That is, the printer 40 may correspond to a so-called "multifunction machine".

The configuration of the ink supply system 1 is not limited to the example illustrated in FIG. 1. For example, the number of printers 40 to which the ink server 10 supplies ink may be one, or may be three or more. Further, the number of colors of ink that the ink server 10 supplies to the printer 40 may be other than six. For example, the ink server 10 may supply only black ink to the printer 40. In this case, the ink server 10 may include only the ink cartridge 20 in which black ink is stored. That is, the ink server 10 may have only one ink cartridge 20 or a plurality of ink cartridges 20. Next, the configuration of the ink server 10 will be described with reference to FIG. 2.

Figure 2:
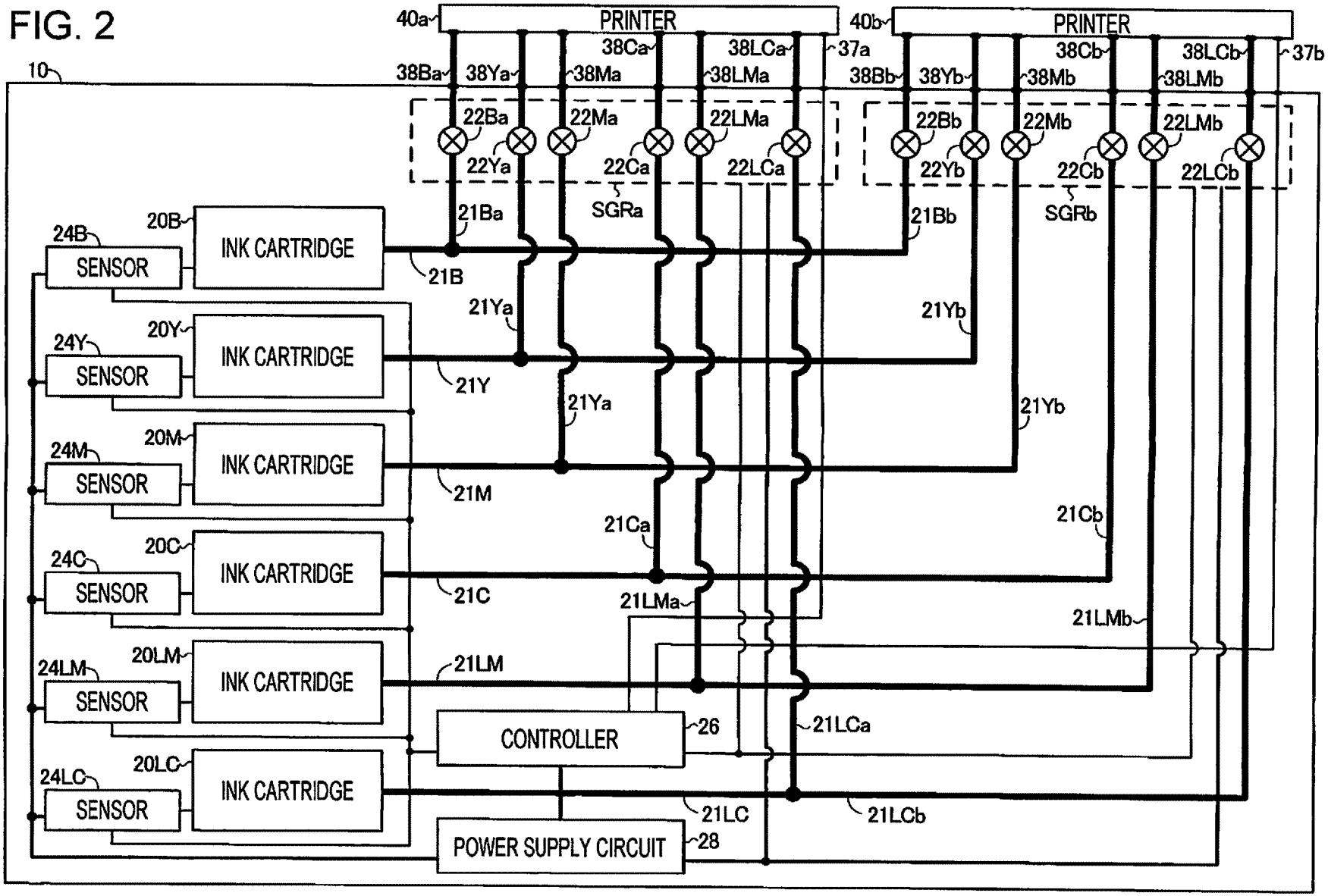
FIG. 2 is a block diagram illustrating a configuration of an ink server.

FIG. 2 is a block diagram showing the configuration of the ink server 10. In FIG. 2, the printers 40*a* and 40*b* are also shown for easy understanding. In FIG. 2, in order to distinguish the plurality of ink cartridges 20 from each other, one of "B", "Y", "M", "C", "LM", and "LC" indicating the colors of ink is appended to the end of the reference sign of the ink cartridge 20. The element such as the sensor 24 provided corresponding to the ink cartridge 20 has, at the end of the reference sign, the same alphabet as the alphabet appended to the end of the reference sign of the corresponding ink cartridge 20. Further, the element such as the switching unit 22 that is distinguished corresponding to the printers 40*a* and 40*b* has, at the end of the reference sign, the same alphabet as the alphabet appended to the end of the reference sign of the corresponding printer 40.

In addition, also in description after FIG. 2, each element may be described with the alphabet appended to the end of the reference sign being omitted. For example, the switching units 22Ba, 22Ya, 22Ma, 22Ca, 22LMa, 22LCa, 22Bb, 22Yb, 22Mb, 22Cb, 22LMb and 22LCb may be referred to as the switching unit 22 without particular distinction.

Further, in FIG. 2, in order to make the figure easier to see, the signal wiring coupled to the respective switching units 22Ba, 22Ya, 22Ma, 22Ca, 22LMa and 22LCa is collectively described for a switching unit group SGRa including the switching units 22Ba, 22Ya, 22Ma, 22Ca, 22LMa and 22LCa. Similarly, the signal wiring coupled to the respective switching units 22Bb, 22Yb, 22Mb, 22Cb, 22LMb, and 22LCb is collectively described for a switching unit group SGRb including the switching units 22Bb, 22Yb, 22Mb, 22Cb, 22LMb, and 22LCb. Further, the power supply wiring coupled to each of the plurality of switching units 22 is collectively described for each switching unit group SGRa and SGRb.

An ink cartridge 20B stores black ink to be supplied to the printers 40*a* and 40*b*. An ink cartridge 20Y stores yellow ink to be supplied to the printers 40*a* and 40*b*. An ink cartridge 20M stores magenta ink to be supplied to the printers 40*a* and 40*b*. An ink cartridge 20C stores cyan ink to be supplied to the printers 40*a* and 40*b*. An ink cartridge 20LM stores light magenta ink to be supplied to the printers 40*a* and 40*b*. An ink cartridge 20LC stores light cyan ink to be supplied to the printers 40*a* and 40*b*.

One of the plurality of ink cartridges 20 is an example of a first ink storage unit, and the other one of the plurality of ink cartridges 20 is an example of a second ink storage unit. One of the plurality of colors of ink is an example of a first color of ink, and the other one of the plurality of colors of ink is an example of a second color of ink. For example, the ink cartridge 20B is an example of the first ink storage unit, and the ink cartridge 20Y is an example of the second ink storage unit. In this case, the black ink is an example of the first color of ink, and the yellow ink is an example of the second color of ink. The plurality of ink cartridges 20 is the same as each other except for the color of the stored ink. Therefore, in FIG. 2, the configuration and operation of the ink server 10 will be described with attention paid to the ink cartridge 20B among the plurality of ink cartridges 20.

The ink cartridge 20B is coupled to the switching units 22Ba and 22Bb via a flow path 21B. For example, the flow path 21B of ink stored in the ink cartridge 20B branches into a flow path 21Ba and a flow path 21Bb. The flow path 21Ba is coupled to the switching unit 22Ba, and the flow path 21Bb is coupled to the switching unit 22Bb. As described above, the ink server 10 includes a plurality of switching units 22 for each ink cartridge 20.

The switching unit 22Ba is coupled to the ink supply tube 38Ba coupled to the printer 40*a*. The switching unit 22Ba opens/closes the outlet of the flow path 21Ba in accordance with control from controller 26, for example. When the outlet of the flow path 21Ba is closed, the ink stored in the ink cartridge 20B is not supplied to the printer 40*a*. When the outlet of the flow path 21Ba is open, the ink stored in the ink cartridge 20B is supplied to the printer 40*a* from the ink cartridge 20B through the flow paths 21B and 21Ba and the ink supply tube 38Ba.

Furthermore, the switching unit 22Ba may adjust the degree of opening of the outlet of the flow path 21Ba in accordance with control from the controller 26. The flow rate of the ink supplied to the printer 40*a* is adjusted by adjusting the degree of opening of the outlet of the flow path 21Ba. That is, the switching unit 22Ba may adjust the flow rate of the ink supplied to the printer 40*a* in accordance with control from the controller 26. The material of the flow path 21 and the material of the ink supply tube 38 are not particularly limited. The ink supply tube 38 may be detachably attached to the ink server 10 and the printer 40.

A sensor 24B detects, as the ink state, any of the remaining amount of ink stored in the ink cartridge 20B, the viscosity of ink, the use period of ink, and the degree of sedimentation of ink components in accordance with control from the controller 26. That is, the sensor 24B may detect one or all of the remaining amount of ink stored in the ink cartridge 20B, the viscosity of ink, the use period of ink, and the degree of sedimentation of ink components. Alternatively, the sensor 24B may detect two or three of the remaining amount of ink stored in the ink cartridge 20B, the viscosity of ink, the use period of ink, and the degree of sedimentation of ink components. The detection result of the ink state is output from the sensor 24B to the controller 26.

Here, an example of a method of detecting the remaining amount of ink and the like will be briefly described. For example, the sensor 24B may drive a piezoelectric element (not shown) mounted on the ink cartridge 20B and detect the remaining amount of ink based on residual vibration caused by the driving of the piezoelectric element. The sensor 24B may detect the temperature inside the ink cartridge 20B or the temperature around the ink cartridge 20B. In this case, the controller 26 may calculate the viscosity of ink based on the temperature detected by the sensor 24B. Further, the sensor 24B may calculate the use period of ink based on the date and time when the ink cartridge 20B is mounted on the ink server 10. The sensor 24B may calculate the degree of sedimentation of ink components based on the length of time for which the ink is not supplied from the ink cartridge 20B to the printer 40. The sensor 24B may detect the degree of sedimentation of ink components based on the residual vibration. The detection methods such as the remaining amount of ink, the viscosity of ink, the use period of ink, and the degree of sedimentation of ink components are not limited to the above examples.

The controller 26 controls the switching unit 22 and the sensor 24. For example, the controller 26 receives an ink request signal for requesting supply of ink to the printer 40*a* from the printer 40*a* via the signal line 37*a*. The controller 26 controls the plurality of switching units 22 included in the switching unit group SGRa based on the ink request signal from the printer 40*a*. The plurality of switching units 22 included in the switching unit group SGRa opens/closes their respective outlets of the plurality of flow paths 21 in accordance with control from the controller 26 based on the ink request signal. As a result, the ink is supplied to the printer 40*a* based on the ink request signal. The signal lines 37*a* and 37*b* may be detachably attached to the ink server 10 and the printer 40.

In addition, the controller 26 acquires the detection result of the ink state from the sensor 24 regardless of whether there is a command from the outside of the ink server 10. For example, the controller 26 may cause the sensor 24 to detect the ink state regardless of whether there is a command from the outside of the ink server 10 and acquire the detection result of the ink state from the sensor 24. That is, the controller 26 autonomously causes the sensor 24 to detect the ink state, and acquires the detection result of the ink state from the sensor 24.

For example, the controller 26 may cause the sensor 24 to detect the ink state periodically. That is, the controller 26 may periodically acquire the detection result of the ink state from the sensor 24. When the detection period of the ink state is preset, the controller 26 may determine, based on the time measured using a timer (not shown) and the detection period, whether the current time is the detection timing at which the ink state is detected. When determining that the current time is the detection timing, the controller 26 may cause the sensor 24 to detect the ink state.

Further, the controller 26 may cause the sensor 24 to detect the ink state according to a predetermined detection schedule. That is, the controller 26 may acquire the detection result of the ink state from the sensor 24 according to the detection schedule. The detection schedule that detects the ink state may be set by the user of the ink server 10, for example.

When the detection result of the ink state is not normal, the controller 26 notifies the user of a warning. Specifically, when the remaining amount of ink stored in the ink cartridge 20B is less than a predetermined value, the controller 26 displays a warning prompting replacement of the ink cartridge 20B on a display (not shown) of the ink server 10 or the like. When the degree of sedimentation of ink components stored in the ink cartridge 20B is a predetermined amount or more, the controller 26 may perform control for stirring the ink stored in the ink cartridge 20B. Further, the controller 26 may adjust the temperature inside the ink cartridge 20 or the temperature around the ink cartridge 20 based on the detection result of the viscosity of ink in order to maintain the viscosity of ink in an optimal state.

The power supply circuit 28 supplies a power supply voltage to each functional block in the ink server 10. Specifically, the power supply circuit 28 supplies a power supply voltage to the switching unit 22, the sensor 24, and the controller 26. As a result, the controller 26 and the like can operate regardless of whether the power supply voltage is supplied to the printer 40. For example, the controller 26 may cause the sensor 24 to detect the ink state, and acquire the detection result of the ink state from the sensor 24 regardless of whether the power supply voltage is supplied to the printer 40.

In this way, since the ink server 10 includes the controller 26 and the power supply circuit 28, the maintenance and management of the ink from the determination of whether the ink state is detected to the acquisition of the ink state detection result can be performed autonomously. As a result, the ink server 10 can stably supply ink to the printer 40 without depending on an external device such as the printer 40 or a power supply environment. Further, since the ink server 10 does not require supply of the power supply voltage from the printer 40, the coupling with the printer 40 can have various coupling forms.

In addition, since the ink server 10 includes a plurality of switching units 22 for each ink cartridge 20, the ink stored in the ink cartridge 20 can be supplied to the plurality of printers 40. For example, the ink server 10 may supply the ink stored in the ink cartridge 20 to the plurality of printers 40 simultaneously.

The configuration of the ink server 10 is not limited to the example illustrated in FIG. 2. For example, the switching of whether to supply the ink stored in the ink cartridge 20 to the printer 40 may be performed by a pressurizing pump (not shown) that pressurizes the ink storage container in the ink cartridge 20. The ink storage container may be, for example, an ink pack that stores the ink in an airtight state. In this case, the controller 26 may adjust the flow rate of ink supplied to the printer 40 by controlling the pressurizing pump. The ink server 10 may be coupled to the printer 40 wirelessly using a wireless local area network (LAN) or the like. In this case, the signal lines 37*a* and 37*b* and the like may be omitted.

Figure 3:
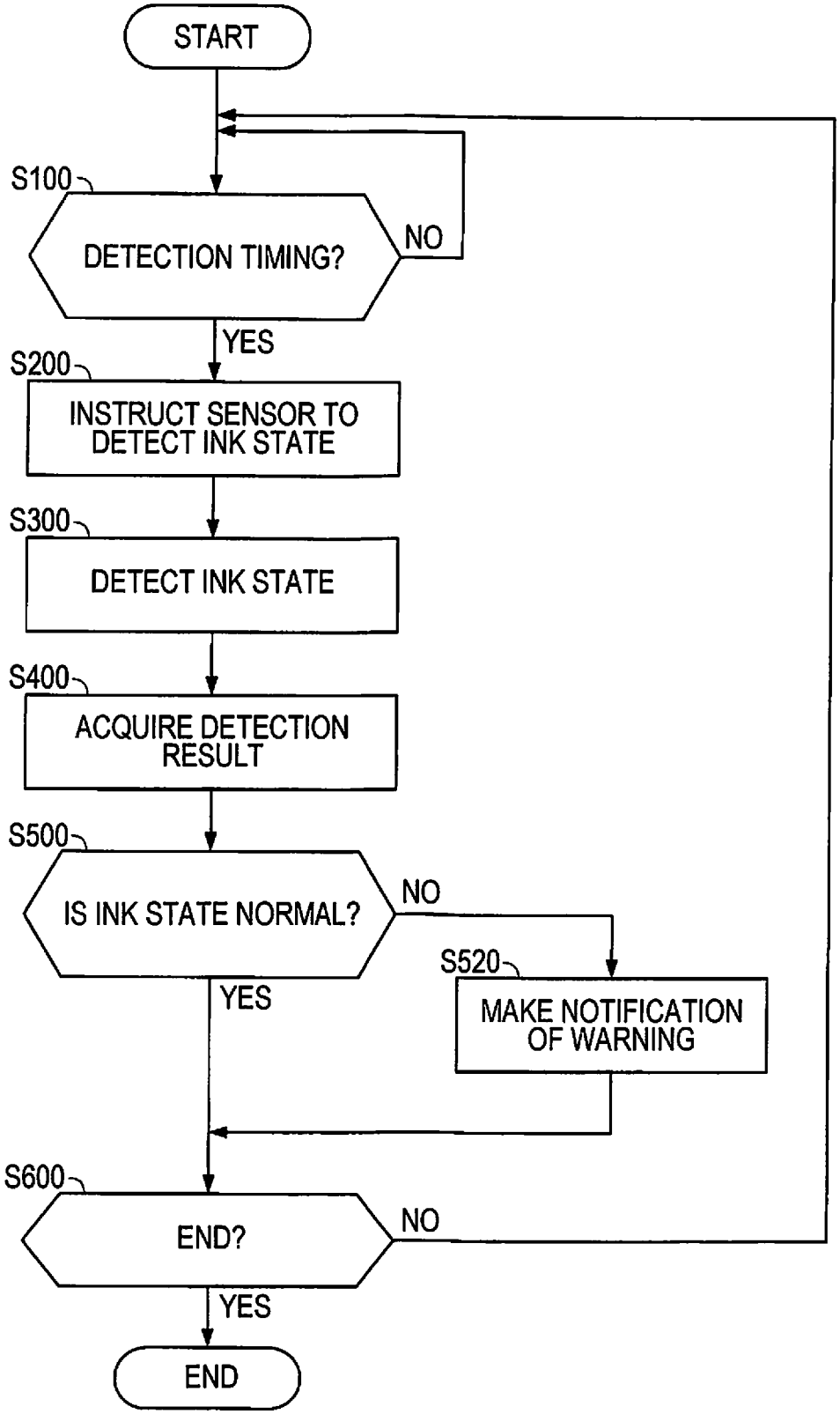
FIG. 3 is a flowchart illustrating an example of the operation of the ink server.

FIG. 3 is a flowchart illustrating an example of the operation of the ink server 10. FIG. 3 shows the operation of the ink server 10 relating to the management of the ink stored in the ink cartridge 20.

First, in step S100, the controller 26 determines whether the current time is a detection timing at which the ink state is detected. For example, when the controller 26 has a timer that generates a timer interrupt every time the detection period time elapses from the start of time measurement, the controller 26 determines that the current time is the detection timing at which the ink state is detected when the timer interrupt occurs. The detection period time is a time corresponding to the period at which the ink state is detected. Further, for example, the controller 26 may determine whether the current time is the detection timing at which the ink state is detected according to a predetermined detection schedule.

When the determination result in step S100 is affirmative, the controller 26 instructs the sensor 24 to detect the ink state in step S200, and the process proceeds to step S300. On the other hand, when the result of the determination in step S100 is negative, the controller 26 returns the process to step S100.

In step S300, the sensor 24 detects, as the ink state, any of the remaining amount of ink stored in the ink cartridge 20, the viscosity of ink, the use period of ink, and the degree of sedimentation of ink components. The ink server 10 advances the process to step S400.

In step S400, the controller 26 acquires the detection result of the ink state from the sensor 24. The controller 26 advances the process to step S500.

In step S500, the controller 26 determines whether the ink state is normal based on the detection result of the sensor 24. When the result of the determination in step S500 is affirmative, the controller 26 advances the process to step S600. On the other hand, when the result of the determination in step S500 is negative, the controller 26 advances the process to step S520.

In step S520, the controller 26 notifies the user of the ink server 10 of a warning that the ink state is not normal. For example, when the remaining amount of ink stored in the ink cartridge 20B is less than a predetermined value, the controller 26 notifies the user of the ink server 10 of a warning for prompting replacement of the ink cartridge 20B. As a result, the user can replace the ink cartridge 20B before the ink stored in the ink cartridge 20B is depleted. The controller 26 advances the process to step S600 after performance of the process of step S520.

In step S600, the controller 26 determines whether to end the process related to management of the ink stored in the ink cartridge 20. For example, when the ink server 10 is stopped, the controller 26 determines that the process related to the management of the ink stored in the ink cartridge 20 is ended. When the result of the determination in step S600 is affirmative, the controller 26 ends the process relating to management of the ink stored in the ink cartridge 20. On the other hand, when the result of the determination in step S600 is negative, the controller 26 returns the process to step S100.

The operation of the ink server 10 is not limited to the example shown in FIG. 3. For example, when the sensor 24 is a thermometer or the like that does not require control from the controller 26, the processes in steps S200 and S300 may be omitted. For example, based on the detection result of the sensor 24, the controller 26 may perform control of stirring the ink stored in the ink cartridge 20, or may adjust the temperature inside the ink cartridge 20 or the temperature around the ink cartridge 20.

As described above, in this embodiment, the ink server 10 includes the ink cartridge 20 that stores ink to be supplied to the printer 40, and the switching unit 22 that switches whether to supply the ink stored in the ink cartridge 20 to the printer 40. Further, the ink server 10 includes the sensor 24 that detects the state of ink stored in the ink cartridge 20, the controller 26 that controls the switching unit 22 and the sensor 24, and the power supply circuit 28 that supplies a power supply voltage to the switching unit 22, the sensor 24, and the controller 26. In this way, in this embodiment, since the ink server 10 includes the controller 26 and the power supply circuit 28, the ink server 10 can be stably operated as a stand-alone ink server.

For example, the ink server 10 can autonomously perform the process relating to the maintenance and management of the ink from the determination of whether the ink state is detected to acquisition of the ink state detection result. As a result, the ink server 10 can stably supply ink to the printer 40 without depending on an external device such as the printer 40 or a power supply environment.

When the ink cartridge 20 has a plurality of switching units 22, the ink server 10 can stably supply the ink stored in the ink cartridge 20 to the plurality of printers 40.

The above-described embodiment can be variously modified. Specific modifications are exemplified below. Two or more aspects of any selected from the following examples can be appropriately combined as long as they do not contradict each other. First, a first modification will be described.

In the first modification, the controller 26 in the above-described embodiment may cause the sensor 24 to detect the ink state in response to a command from the printer 40. That is, in the first modification, the controller 26 may have a first mode in which the detection result of the ink state is acquired from the sensor 24 depending on the command from the printer 40, and a second mode in which the detection result of the ink state is acquired from the sensor 24 without depending on the command from the printer 40. The operation of the ink server 10 in the first modification will be described with reference to FIG. 4.

Figure 4:
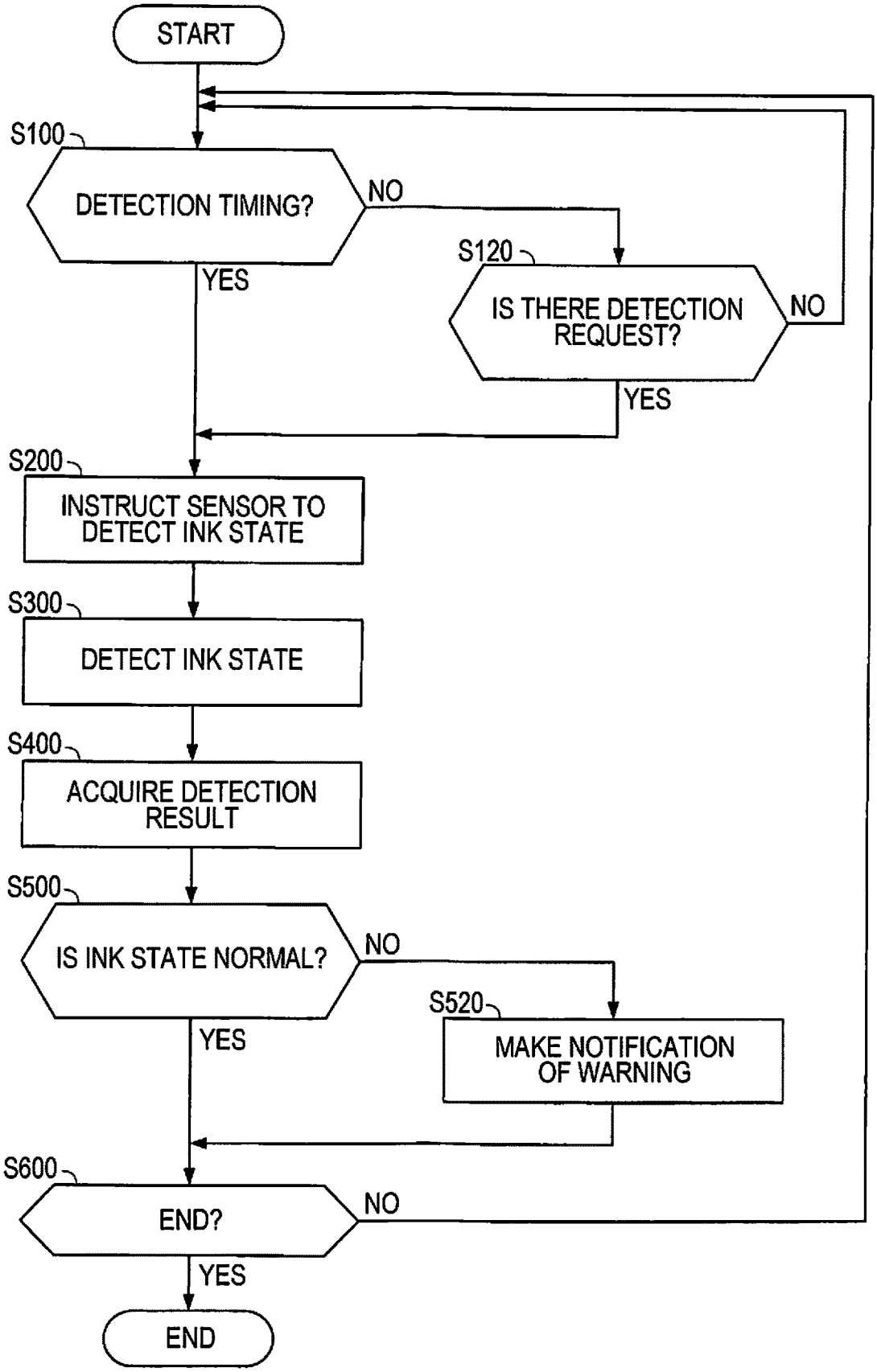
FIG. 4 is a flowchart illustrating an example of an operation of an ink server in a first modification.

FIG. 4 is a flowchart illustrating an example of the operation of the ink server 10 according to the first modification. FIG. 4 shows the operation of the ink server 10 relating to the management of the ink stored in the ink cartridge 20, as in FIG. 3. The operation in FIG. 4 is the same as the operation in FIG. 3 except that the determination in step S120 is attached to the operation in FIG. 3. The determination in step S120 is performed when the determination result in step S100 is negative.

For example, in step S100, the controller 26 determines whether the current time is the detection timing at which the ink state is detected. When the determination result in step S100 is affirmative, the controller 26 instructs the sensor 24 to detect the ink state in step S200, and the process proceeds to step S300. On the other hand, when the result of the determination in step S100 is negative, the controller 26 advances the process to step S120.

In step S120, the controller 26 determines whether to receive a detection request for requesting detection of the ink state from the printer 40. When the result of determination in step S120 is affirmative, in step S200, the controller 26 instructs the sensor 24 to detect the ink state based on detection request, and the process proceeds to step S300. On the other hand, when the result of the determination in step S120 is negative, the controller 26 returns the process to step S100.

That is, in first modification, when the result of the determination in step S100 is affirmative, the controller 26 performs operation in the second mode in which the detection result of the ink state is acquired from the sensor 24 without depending on the command from the printer 40. In the first modification, when the result of the determination in step S120 is affirmative, the controller 26 performs operation in the first mode in which the detection result of the ink state is acquired from the sensor 24 depending on the command from the printer 40. Since the series of processes from step S300 to step S520 in FIG. 4 is the same as the series of processes from step S300 to step S520 in FIG. 3, the description will be omitted.

Also in the first modification, the ink can be stably supplied to the printer 40 as in the above-described embodiment. Furthermore, in the first modification, the state of the ink stored in the ink cartridge 20 can be detected in response to a request from the printer 40. Next, a second modification will be described.

In the second modification, a plurality of ink cartridges 20 in the above-described embodiment or the first modification may be provided for one color ink. An example of the configuration of an ink server 11 in the second modification will be described with reference to FIG. 5.

Figure 5:
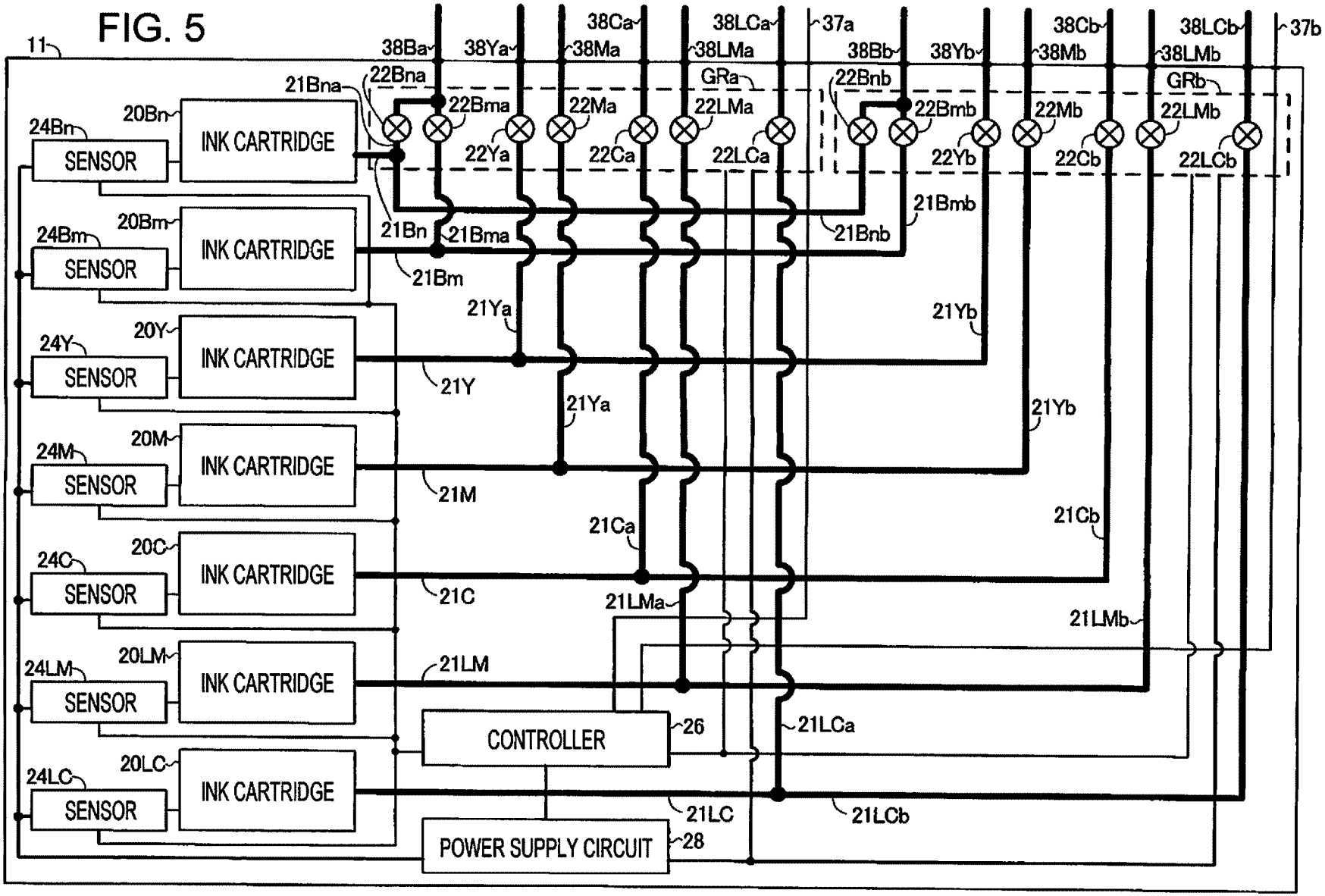
FIG. 5 is a block diagram illustrating a configuration of an ink server in a second modification.

FIG. 5 is a block diagram illustrating a configuration of the ink server 11 according to the second modification. The same elements as those already described in FIGS. 1 and 2 are denoted by the same reference signs, and detailed description thereof is omitted. In FIG. 5, in order to distinguish between the two ink cartridges 20B in which the black ink is stored, "m" or "n" is appended to the end of the reference signs of the two ink cartridges 20B. Similarly, "m" or "n" is appended to the end of the reference sign of each of the two sensors 24B. Further, "ma", "na", "mb", or "nb" is appended to the end of the reference sign of each of the four switching units 22B. Further, the alphabets at the end of the reference sign of the flow path 21B correspond to the alphabets at the end of the reference sign of the ink cartridge 20B or the switching unit 22B.

The ink server 11 is the same as the ink server 10 except that an ink cartridge 20Bn, switching units 22Bna and 22Bnb, a sensor 24Bn, flow paths 21Bn, 21Bna and 21Bnb are added to the ink server 10 of FIG. 2.

Ink cartridges 20Bm and 20Bn store black ink to be supplied to the printers 40*a* and 40*b*. One of the ink cartridges 20Bm and 20Bn is an example of a third ink storage unit, and the other of the ink cartridges 20Bm and 20Bn is an example of a fourth ink storage unit.

The ink cartridge 20Bm is coupled to the switching units 22Bma and 22Bmb via a flow path 21Bm. For example, the flow path 21Bm of ink stored in the ink cartridge 20Bm branches into a flow path 21Bma and a flow path 21Bmb on the way. The flow path 21Bma is coupled to a switching unit 22Bma, and the flow path 21Bmb is coupled to a switching unit 22Bmb. Similarly, the ink cartridge 20Bn is coupled to switching units 22Bna and 22Bnb via a flow path 21Bn. For example, the flow path 21Bn of ink stored in the ink cartridge 20Bn branches into a flow path 21Bna and a flow path 21Bnb on the way. The flow path 21Bna is coupled to a switching unit 22Bna, and the flow path 21Bnb is coupled to a switching unit 22Bnb.

The switching units 22Bma and 22Bna are the same as the switching unit 22Ba in FIG. 2, and the switching units 22Bmb and 22Bnb are the same as the switching unit 22Bb in FIG. 2. For example, the switching units 22Bma and 22Bna are coupled to the ink supply tube 38Ba coupled to the printer 40*a*. The switching unit 22Bma opens/closes the outlet of the flow path 21Bma in accordance with control from the controller 26, and the switching unit 22Bna opens/closes the outlet of the flow path 21Bna in accordance with control from the controller 26. The switching units 22Bmb and 22Bnb are coupled to an ink supply tube 38Bb coupled to the printer 40*b*. The switching unit 22Bmb opens/closes the outlet of the flow path 21Bmb in accordance with control from the controller 26, and the switching unit 22Bb opens/closes the outlet of the flow path 21Bnb in accordance with control from the controller 26.

A sensor 24Bm detects, as the ink state, any of the remaining amount of ink stored in the ink cartridge 20Bm, the viscosity of ink, the use period of ink, and the degree of sedimentation of ink components in accordance with control from the controller 26. The sensor 24Bn detects, as the ink state, any of the remaining amount of ink stored in the ink cartridge 20Bn, the viscosity of ink, the use period of ink, and the degree of sedimentation of ink components in accordance with control from the controller 26.

A plurality of ink cartridges 20 may be provided for ink of a color other than black. For example, the ink server 11 may include each one of the ink cartridges 20B, 20M, 20C, 20LM, and 20LC, and the two ink cartridges 20Y. Alternatively, the ink server 11 includes each one of the ink cartridges 20M, 20C, 20LM, and 20LC, the two ink cartridges 20B, and the two ink cartridges 20Y. The switching unit 22Bna may be coupled to the printer 40*a* using an ink supply tube 38B that is different from the ink supply tube 38Ba that couples the switching unit 22Bma and the printer 40*a*. Similarly, the switching unit 22Bnb may be coupled to the printer 40*b* using the ink supply tube 38B that is different from the ink supply tube 38Bb that couples the switching unit 22Bmb and the printer 40*b*.

Also in the second modification, the same effect as the above-described embodiment or the first modification can be obtained. Further, in the second modification, a plurality of ink cartridges 20 is provided for one color. For this reason, in the second modification, even when the ink stored in one of the plurality of ink cartridges 20 provided for one color is depleted, the ink can be supplied to the printer 40 from another ink cartridge 20 without waiting for the ink cartridge 20 to be replaced. Next, a third modification will be described.

In the third modification, the power supply circuit 28 in the above-described embodiment, the first modification or the second modification may supply a power supply voltage to the printer 40. An example of the configuration of an ink server 12 in the third modification will be described with reference to FIG. 6.

Figure 6:
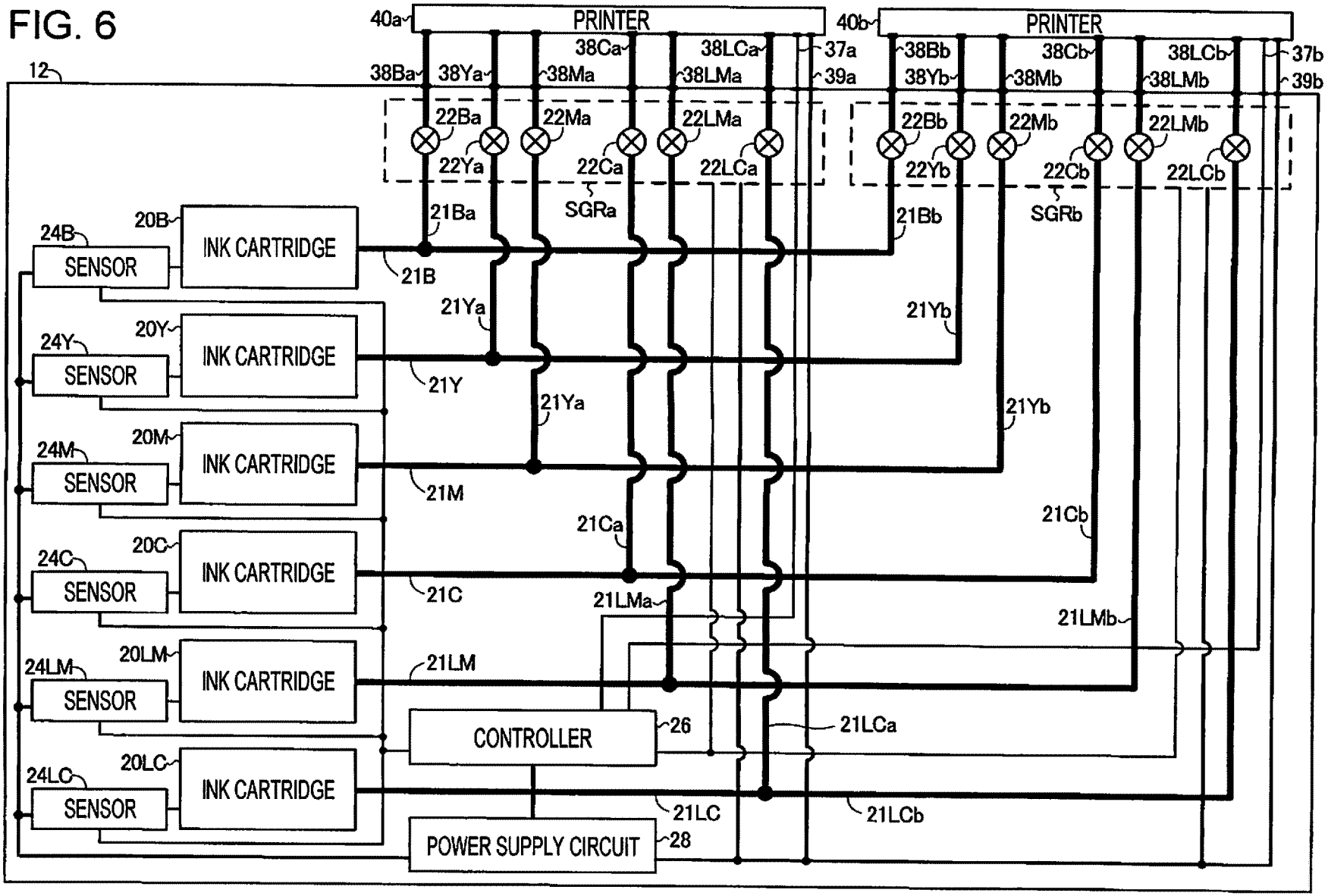
FIG. 6 is a block diagram illustrating a configuration of an ink server in a third modification.

FIG. 6 is a block diagram illustrating a configuration of the ink server 12 in the third modification. The same elements as those already described in FIGS. 1 and 2 are denoted by the same reference signs, and detailed description thereof is omitted. The ink server 12 is the same as the ink server 10 in FIG. 2 except that the power supply voltage is supplied to the printer 40. For example, the power supply circuit 28 supplies a power supply voltage to the printer 40*a* via a power supply line 39*a*, and supplies a power supply voltage to the printer 40*b* via a power supply line 39*b*. The power lines 39*a* and 39*b* may be detachably attached to the ink server 12 and the printer 40. In the ink server 11 of FIG. 5, the power supply circuit 28 may supply the power supply voltage to the printer 40*a* via the power supply line 39*a* and supply the power supply voltage to the printer 40*b* via the power supply line 39*b*.

Also in the third modification, the same effect as the above-mentioned embodiment, the first modification, or the second modification can be acquired. Furthermore, in third modification, for example, since the ink server 11 supplies a power supply voltage to the printer 40, there is no need to prepare a power supply circuit or the like for each of the plurality of printers 40 to which the ink is supplied from the ink server 11. That is, in the third modification, the configuration of the printer 40 can be simplified. Next, a fourth modification will be described.

In the fourth modification, the ink supply system 1 in the above-described embodiment may include any of a plurality of the ink servers 10 in the above-described embodiment, a plurality of the ink servers 10 in the first modification, a plurality of the ink servers 11 in the second modification, and a plurality of the ink servers 12 in the third modification. An example of an ink supply system 1A in which the two ink servers 10 are coupled to one printer 40 will be described with reference to FIG. 7.

Figure 7:
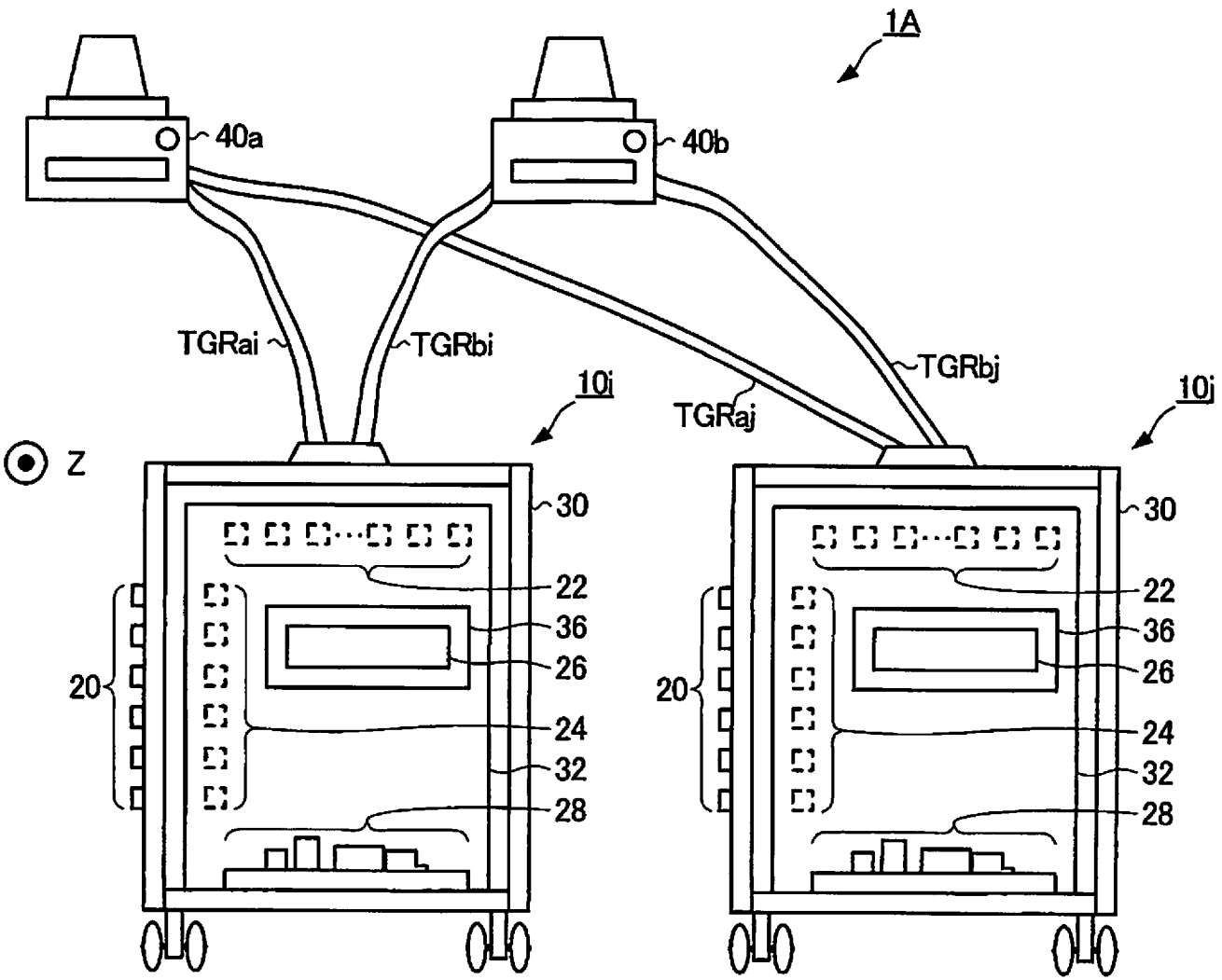
FIG. 7 is an explanatory diagram of an ink supply system in a fourth modification.

FIG. 7 is an explanatory diagram of the ink supply system 1A according to the fourth modification. The same elements as those already described in FIGS. 1 and 2 are denoted by the same reference signs, and detailed description thereof is omitted. In FIG. 7, in order to distinguish the two ink servers 10, "i" or "j" is appended to the end of each reference sign of the two ink servers 10. Similarly, "i" or "j" is appended to the end of each of the two ink supply tube groups TGRa, and "i" or "j" is appended to the end of each of the two ink supply tube groups TGRb. In FIG. 7, the signal lines 37*a* and 37*b* in FIG. 2 are not shown to make the figure easier to see.

The ink supply system 1A includes the printers 40*a* and 40*b* and ink servers 10*i* and 10*j*. The ink servers 10*i* and 10*j* are the same as the ink server 10 of FIG. 1.

The ink server 10*i* supplies ink to the printer 40*a* via the ink supply tube group TGRai, and supplies ink to the printer 40*b* via the ink supply tube group TGRbi. The ink server 10*j* supplies ink to the printer 40*a* via the ink supply tube group TGRaj and supplies ink to the printer 40*b* via the ink supply tube group TGRbj. That is, in the ink supply system 1A, the two ink servers 10*i* and 10*j* are coupled to one printer 40. One of the two ink servers 10*i* and 10*j* operates, for example, when the other of the two ink servers 10*i* and 10*j* is stopped due to failure or inspection. The two ink servers 10*i* and 10*j* may operate in parallel. The ink supply system 1A may have the two ink servers 11 for one printer 40, or may have the two ink servers 12 for one printer 40. Alternatively, the ink supply system 1A may include two of the ink servers 10, 11, and 12 for one printer 40.

Also in the fourth modification, the same effect as any of the above-mentioned embodiment, the first modification, the second modification, and the third modification can be acquired. Furthermore, in the fourth modification, for example, a plurality of ink servers 10 is coupled to one printer 40. For this reason, in the fourth modification, even when one of the plurality of ink servers 10 fails, the ink can be supplied from another ink server 10 to the printer 40 without waiting for the recovery of the failed ink server 10.

What is claimed is:

1. An ink server comprising:

at least one ink storage unit that stores ink to be supplied to a printer;

a switching unit that switches whether to supply the ink stored in the at least one ink storage unit to the printer;

a detection unit that detects a state of the ink stored in the at least one ink storage unit;

a controller that controls the switching unit and the detection unit; and a power supply circuit that supplies a power supply voltage to the switching unit, the detection unit, and the controller, the controller having a first mode in which a detection result is acquired from the detection unit depending on an instruction from the printer, and a second mode in which a detection result is acquired from the detection unit without depending on a command from the printer.

2. The ink server according to claim 1, wherein the controller acquires a detection result from the detection unit regardless of whether there is a command from an outside of the ink server.

3. The ink server according to claim 1, wherein the controller autonomously acquires a detection result from the detection unit.

4. The ink server according to claim 1, wherein the controller acquires a detection result from the detection unit regardless of whether a power supply voltage is supplied to the printer.

5. The ink server according to claim 1, wherein the switching unit adjusts a flow rate of ink supplied to the printer in accordance with control from the controller.

6. The ink server according to claim 1, wherein the at least one ink storage unit comprises a plurality of ink storage units, and wherein a first ink storage unit among the plurality of ink storage units is provided corresponding to a first color of ink of a plurality of colors of ink, and a second ink storage unit among the plurality of ink storage units is provided corresponding to a second color of ink of the plurality of colors of ink.

7. The ink server according to claim 1, wherein the at least one ink storage unit comprises a plurality of ink storage units, and wherein a third ink storage unit and a fourth ink storage unit among the plurality of ink storage units stores a same color of ink.

8. The ink server according to claim 1, wherein the ink server includes a plurality of the switching unit for the at least one ink storage unit.

9. The ink server according to claim 1, wherein the ink stored in the at least one ink storage unit is supplied to a plurality of printers.

10. The ink server according to claim 9, wherein the ink stored in the at least one ink storage unit is simultaneously supplied to the plurality of printers.

11. The ink server according to claim 1, wherein the power supply circuit supplies a power supply voltage to the printer.

12. An ink supply system comprising:

a plurality of the ink servers according to claim 1.

13. An ink server comprising:

at least one ink storage unit that stores ink to be supplied to a printer;

a switching unit that switches whether to supply the ink stored in the at least one ink storage unit to the printer;

a detection unit that detects a state of the ink stored in the at least one ink storage unit;

a controller that controls the switching unit and the detection unit; and a power supply circuit that supplies a power supply voltage to the switching unit, the detection unit, and the controller, the controller autonomously and periodically acquiring a detection result from the detection unit.

14. An ink supply system comprising:

a plurality of the ink servers according to claim 13.

15. An ink server comprising:

at least one ink storage unit that stores ink to be supplied to a printer;

a switching unit that switches whether to supply the ink stored in the at least one ink storage unit to the printer;

a detection unit that detects a state of the ink stored in the at least one ink storage unit;

a controller that controls the switching unit and the detection unit; and a power supply circuit that supplies a power supply voltage to the switching unit, the detection unit, and the controller, the controller autonomously acquiring a detection result from the detection unit according to a predetermined schedule.

16. An ink supply system comprising:

a plurality of the ink servers according to claim 15.

17. An ink server according comprising:

at least one ink storage unit that stores ink to be supplied to a printer;

a switching unit that switches whether to supply the ink stored in the at least one ink storage unit to the printer;

a detection unit that detects a state of the ink stored in the at least one ink storage unit;

a controller that controls the switching unit and the detection unit; and a power supply circuit that supplies a power supply voltage to the switching unit, the detection unit, and the controller, the detection unit detecting some or all of a remaining amount of ink stored in the at least one ink storage unit, a viscosity of ink stored in the at least one ink storage unit, a use period of ink stored in the at least one ink storage unit, and a degree of sedimentation of ink components stored in the at least one ink storage unit.

18. An ink supply system comprising:

a plurality of the ink servers according to claim 17.

* * * * *